US005949635A

United States Patent [19]

Botez

[11] Patent Number: 5,949,635

[45] Date of Patent: Sep. 7, 1999

[54] IONIZER FOR STATIC ELECTRICITY NEUTRALIZATION

[76] Inventor: Dan D. C. Botez, 1736 Meadowlark La., Anaheim, Calif. 92806

[21] Appl. No.: 08/896,115

[22] Filed: Jul. 17, 1997

[51] Int. Cl.[6] ..... H01T 19/04; H05F 03/06

[52] U.S. Cl. ..... 361/213; 361/220

[58] Field of Search ..... 361/212, 213, 361/214, 220, 221, 222, 225; 250/324–326

[56] References Cited

U.S. PATENT DOCUMENTS

| | | | |
|---|---|---|---|
| 1,489,425 | 4/1924 | Chapman | 361/213 |
| 4,092,543 | 5/1978 | Levy | 361/213 |
| 4,107,755 | 8/1978 | Kiefer | 361/222 |
| 4,227,235 | 10/1980 | Bishop | 361/222 |

FOREIGN PATENT DOCUMENTS

| | | | |
|---|---|---|---|
| 3230667 | 2/1984 | Germany | 361/214 |
| 6401567 | 8/1965 | Netherlands | 361/222 |
| 1197132 | 7/1970 | United Kingdom | 361/222 |

*Primary Examiner*—Fritz Fleming

[57] ABSTRACT

A ionizer for neutralizing static electricity generally occurring on synthetic materials during their processing, consists of a row of insulating modules arranged on a metallic shape, connected to the ground. Between the modules, in special slits, on the side faced to the coming charged material, are introduced grounded wires, which make contact to the metallic shape. A high voltage needle is introduced through each insulating module, until makes contact to the conductor of a high voltage cable inserted through the inner part of each module (hot ionizer). The high voltage cable is connected to a high voltage power supply. The high voltage needles can be also capacitively coupled to the high voltage cable (shockless ionizer), connected to a high voltage AC power supply. Between the high voltage needles and the grounded wires occurs a corona discharge which generates ions. A material with a high static charge get neutralized mainly by small electrical discharges to the peaks of the grounded wires. The materials with a small static charge attracts the ions of opposite charge, generated by above corona discharge, until the charge of material becomes neutral. The materials with a average static charge get neutralized by means of both manners.

5 Claims, 2 Drawing Sheets

IONIZER FOR STATIC ELECTRICITY NEUTRALIZATION

BACKGROUND OF THE INVENTION

The invention relates to a ionizer, device which neutralizes static electricity buildup on synthetic fibers, sheets, webs, when such materials are processed. Generally, an ionizer has the appearance of a bar, placed across movement direction of the charged material, on the side of the surface where the static charge is buildup. The distance between the ionizer and material varies from one to five inches. Electrically powered ionizers are energized by a high voltage power supply, by means of a high voltage cable. Hot ionizers are named that ones which have the high voltage needles directly connected (jabbed) into the conductor of the high voltage cable. A person who accidentally touches a needle can receive an electric shock. The severity of this shock depends on the current rating (usually limited to 5 milliamperes) of the high voltage power supply. Shockless ionizers are named that ones which have high voltage needles capacitively coupled to the high voltage cable. Due to the small capacitance between the high voltage needle and the conductor of the high voltage cable, the current is limited to few microamperes, and a direct touch of a high voltage needle is painless.

It is known an ionizer, which, in order to discharge or neutralize static electricity, consists of a row of high voltage needles inserted into the conductor of a high voltage cable, and one or two electrodes connected to the ground, which flank the needles row. A high voltage power supply, of 5 to 15 kV, energizes high voltage needles by a high voltage cable. The other terminal of the high voltage power supply is connected to the ground. Between high voltage needles and grounded electrode/s of ionizer occurs a corona discharge, generating nearby positive and negative ions. The charged material passing through ionized area attracts the necessary quantity of ions of opposite polarity, until its charge gets neutral. This type of ionizer is efficient for materials with a slight or average charge. For the materials with a high or a high large static charge this ionizer is not efficient, because all the ions generated in corona discharge are attracted by the charge of material, but the charge is still not entirely balanced this way. The density of ions is maximum in the area where the distance between high voltage needles and grounded electrode/s is minimum. This fact decreases the efficiency of neutralization.

It is also known an ionizer, named induction or passive ionizer (neutralizer), which consists of a row of needles or thin wires connected to the ground. The material moves nearby the ionizer, and his charge creates an electrical field between grounded needles and itself. A breakdown of the air appears when the electrical field at the peaks of the needles exceeds a threshold value. A small electrical discharge occurs between the charged surface and the grounded needles, this way the material gets discharged. The breakdown of the air and small electrical discharge stop in the moment when the value of the electrical field between the charged surface and grounded needles drops under threshold value. Therefore on the material remains a residual charge which is no more possible to be neutralized this way. The induction ionizer is inefficient for the materials with slight static charge, which can not create an electrical field higher than threshold value.

There is also known an ionizer which consists of a row of high voltage needles, connected to a high voltage power supply. On both sides, along of high voltage needles row, are arranged two saw-teeth shape electrodes, connected to the ground. Between the high voltage needles and grounded electrodes takes place a corona discharge, generating positive and negative ions. The materials with a slight static charge get discharged by attracting ions of opposite polarity. High static charges get neutralized mainly by small electrical discharges between the peaks of the teeth of the grounded electrodes and charged material. The materials having an average static charge get neutralized by small electrical discharges to the peaks of grounded electrodes, as well by attracting ions of opposite polarity.

This type of ionizer is not enough efficient because the density of ions is not uniform. The corona discharge is perpendicular to the axis of the ionizer and occurs mainly where the distance between the high voltage needles and grounded electrodes is minimum. The density of ions is maximum in the area where the corona discharge takes place, and lowers to a minimum at the half of the distance between the needles. Consequently, the neutralization of the electrical charge of the material is good in the areas where the ions density is maximum, and decreases in the areas where the ions density is poor. The result of the decreased neutralization in these areas is an increasing of the residual electrical charge on the material.

U.S. Pat. No. 4,216,518 refers to a Capacitively Coupled Static Eliminator with High Voltage Shield. It consists of a grounded metallic U shape housing, which supports high voltage electrode (plate configuration) and surrounding insulation, high voltage needles, capacitively coupled with high voltage electrode and high voltage shield. An AC high voltage power supply energizes high voltage electrode and shield. This ionizer is efficient for neutralization of slight or average static charges. The corona discharge current between high voltage needle and grounded U shape housing is limited by the capacitance between high voltage needle and high voltage electrode and shield. Consequently the quantity of generated ions is limited. For the materials with a high or a very high static charge this ionizer is not efficient, because all the ions generated in corona discharge are attracted by the charge of material, but the charge is still not entirely balanced this way.

In Romanian patent no.96753, 1988, inventor Dan D.C. Botez, is presented an apparatus meant for static charge neutralization consisting of a high voltage AC power supply which energizes by a high voltage cable/s one ionizer or more. Referring strictly to ionizer, it is made in the form of a metallic shape supporting insulating modules. A high voltage needle is introduced through each insulating module and makes contact to the conductor of a high voltage cable, placed in the inner part of the insulating module. Between the insulating modules, on both sides, are inserted thin steel wires connected by metallic shape to the ground. This way, each high voltage needle is located in the middle of a rectangle, whose corners contain the peaks of the grounded wires. Between the high voltage needles and peaks of grounded wires takes place a corona discharge, that generates positive and negative ions. The materials with a slight electrical charge get discharged by attracting ions of opposite polarity. High static charges get neutralized mainly by small electrical discharges between the peaks of the grounded wires and charged material. The materials having an average electrical charge get neutralized by small electrical discharges to the peaks of grounded wires, as well by attracting ions of opposite polarity. This type of ionizer has a good efficiency for small, average as well for high and very high static charges. The disadvantages of this ionizer are: a slightly increased ozone generation, because of intense corona discharge; in the inner part of the insulating module is a short path between the high voltage needle via joint of insulated modules to the grounded metallic shape, where a small electrical discharge can take place. The dirt built up on the top surface of ionizer can develop, between high voltage needles and grounded wires, a path with a lower surface resistance, and consequently a leakage current can appear. If the ionizer is not regularly cleaned, a small electrical discharge is possible to develop on this path.

BRIEF SUMMARY OF THE INVENTION

The object of the present invention is to provide a ionizer, device for neutralization of static electricity, having efficiency both for materials with slight, average, high, and very high buildup static charge, having a low ozone generation. The ionizer according to the invention has also desirable features to avoid: leakage currents and electrical discharges on its top dirty surface between high voltage needles and grounded electrodes, as well inner electrical discharges between the high voltage needles, via joint of insulated modules, to the grounded metallic support. There are presented two types of ionizers: a hot ionizer, and a shockless ionizer.

According to the present invention, the hot ionizer consists of a row of insulating modules arranged on a metallic shape connected to the ground. In the inner part of the modules, symmetrical relative to lateral sides, is inserted a high voltage cable. A high voltage needle is introduced through each insulated module, and makes contact to the conductor of the high voltage cable. On the one side, faced toward coming charged material, between the insulating modules are fastened thin steel grounded wires which make contact to the grounded metallic shape. The grounded wires are symmetrically placed between the high voltage needles, and a distance exists between the high voltage needles row and grounded wires row. A high voltage power supply, placed apart, energizes the ionizer, by high voltage cable. A corona discharge, which generates positive and negative ions, takes place between high voltage needles and grounded wires. Compared with ionizer presented in Romanian patent no. 96753, which has two rows of grounded wires, the present ionizer has a single row of grounded wires. This way, corona discharge and ozone generation are consequently reduced. In order to avoid undesirable electrical discharges and current leakage on dirty surface, the insulating module has an edge at one end, and a groove at the other end. At the Joint of the insulating modules, the edge of one module enters into the groove of the next module. This way, the path for any undesirable electrical discharge or current leakage becomes so long, that they can not develop themselves.

The materials with a slight static charge attract ions of opposite polarity until their charge gets neutral. High and very high static charges get discharged mainly by small electrical discharges between the peaks of grounded wires and charged material. The materials having an average static charge get neutralized by small electrical discharges to the peaks of grounded wires, as well by attracting ions of opposite polarity.

The appearance and the dimensions of the shockless ionizer are similar with that of hot ionizer. The only one difference is that the high voltage needles make contact to semicircular electrodes, placed over the insulation of high voltage cable. The semicircular electrode represents one plate, the inner conductor of the high voltage cable represents the other plate, and the insulation of the high voltage cable represents the dielectric of a small capacitor (few pF. to few tenfold pF.). Due to this small capacitor, the current which flows through human body in the case of an direct touch is severely reduced, and can not produce an electrical shock.

DETAILED DESCRIPTION OF THE INVENTION

Figures 1, 2, 3:
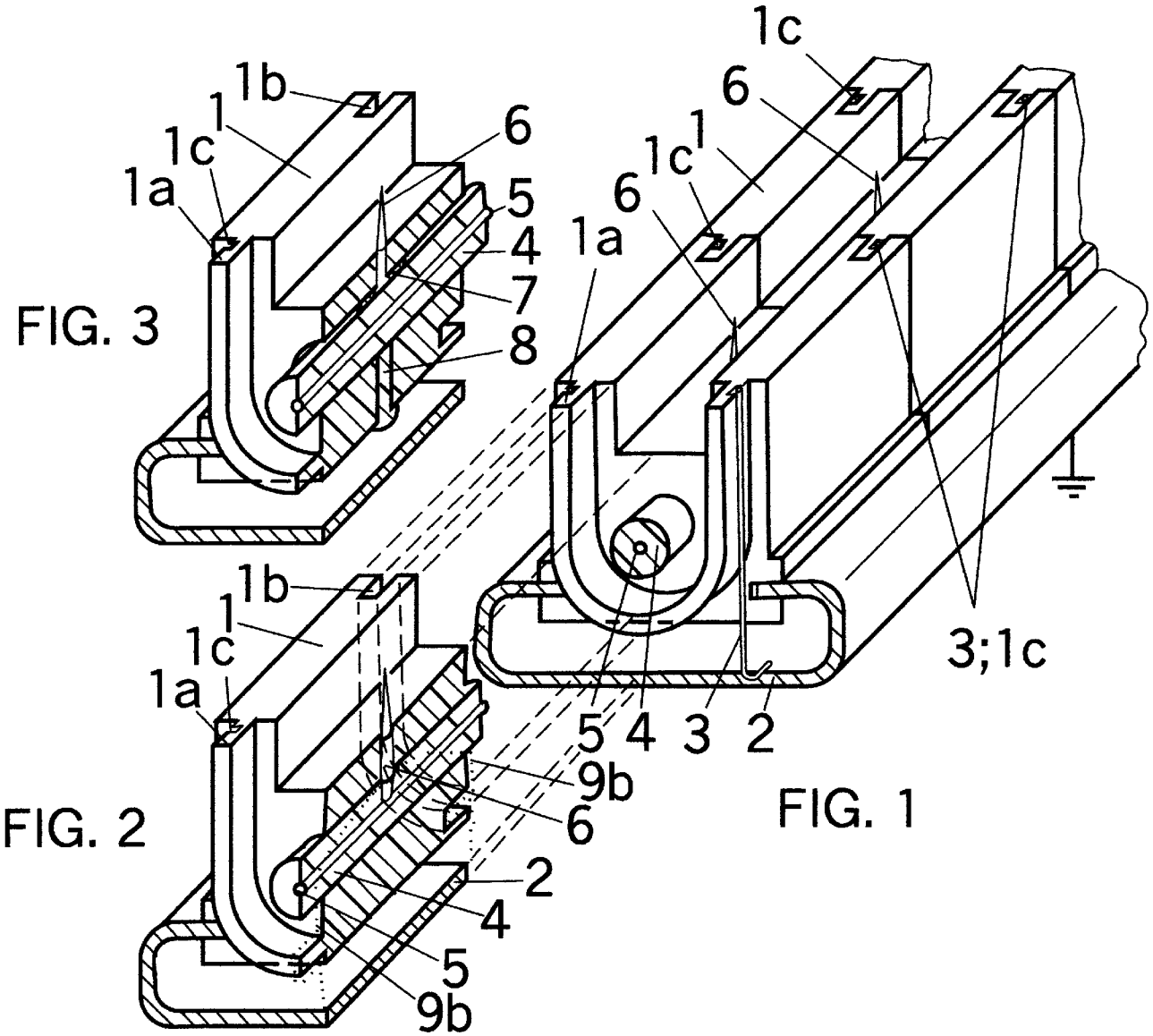
FIG. 1 is a perspective view of a small portion of the hot ionizer, as well of the shockless ionizer, because they have the same external appearance.
FIG. 2 represents a forward moved, sectional perspective view through a module of a hot ionizer. The view is cut by the vertical plane of symmetry.
FIG. 3 is a forward moved and lifted, sectional perspective view through a module of a shockless ionizer. The view is cut by the vertical plane of symmetry.

FIG. 1 shows a perspective view of a small portion of a hot ionizer, as well of a shockless ionizer, because they have the same external appearance. It consists of a row of insulating modules 1, arranged on a metallic shape 2, connected to the ground. On the one side, faced toward coming charged material, in special slits 1*c*, between the insulating modules 1, are fastened thin steel grounded wires 3, which make contact to the grounded metallic shape 2. In the inner part of the insulating modules 1, symmetrical relative to lateral sides, it is inserted a high voltage cable 4, which has an internal conductor 5. The high voltage cable 4 exit from the ionizer, and is connected to a high voltage power supply, placed apart, which energizes the ionizer. The other terminal of the power supply is connected to the ground, where the metallic shape 2 of the ionizer is connected too.

The ionizer is placed across the movement direction of the charged material, on the side where the static charge is buildup. The lateral side of the ionizer where the row of grounded wires 3 are fastened, is faced toward coming charged material. In our case, the material (not shown on the drawing) has a static charge on its down surface, and moves over the ionizer from the right to the left. The distance between the charged material and the top part of ionizer is about one to four inches, depending upon the the static charge of the material, and specific conditions and requirements of each application.

FIG. 2 is a forward moved, sectional perspective view through a module of a hot ionizer. The view is cut by the vertical plane of symmetry. A high voltage needle 6 is introduced through each said insulating module 1, through the insulation of the high voltage cable 4, and makes contact to the internal conductor 5 of the high voltage cable 4. The grounded wires 3 are symmetrically placed between the high voltage needles 6, and a distance exists between the high voltage needles row and grounded wires row. A corona discharge, which generates positive and negative ions, occurs between each high voltage needle 6 and the two grounded wires 3 which flank it. This way, corona discharge of the ionizer consists of a row of zig-zag segments with equal corona discharge current along each segment, due to the fact that the grounded wires 3 are equally spaced between high voltage needles 6. Consequently, the quantity of ions generated along each segment is equal, and the density of ions is constant along the ionizer.

The materials which have a high or very high static charge get neutralized mainly by the phenomenon which takes place at the induction type ionizers. While the material approach to ionizer, an electrical field develops between its charged surface and grounded wires 3. A breakdown of the air appears when the electrical field at the peaks if the grounded wires 3 exceeds a threshold value. A small electrical discharge occurs between the charged surface and the grounded wires 3, and the static charge gets discharged. The breakdown of the air and the small electrical discharge stop in the moment when the value of the electrical field between the charged surface and grounded wires 3 drops under threshold value. Therefore on the material remains a residual charge which is no more possible to be neutralized this way. Immediately following this, the material with residual charge passes over the ionized area, and attracts the necessary quantity of ions of opposite polarity, until its charge gets neutral The materials with an average static charge which can develop an electrical field which exceeds the threshold value, start discharging to the grounded wires 3, and the residual charge gets neutralized by attracting the ions of opposite polarity, while passing over the ionized area.

The materials with slight static charge can not develop an electrical field which exceeds the threshold value. Their charge gets neutral only by attracting the ions of opposite polarity, while they pass over ionized area.

It has been showed above that the density of ions is constant along the ionizer, and consequently the surface of the material will be uniformly neutralized. The result is a good efficiency of the ionizer.

Corona discharge current, and consequently the ozone generation, are diminished because the corona discharge takes place only between the high voltage needles 6 and a single row of grounded wires 3.

The insulating modules 1 have an edge la at one end, and a groove 1*b* at another end. The shape and the dimensions of the edge 1*a* and the groove 1*b* fit each other. At the joint of the insulating modules 1, the edge 1*a* of one insulating module 1 enters into the groove 1*b* of the next insulating module 1. On the external side of each edge 1*a*, in a special slit 1*c*, is placed a grounded wire 3, which is fastened in there when the insulating modules 1 are arranged on the metallic shape 2. Corona discharge between the peaks of the high voltage needles 6, and the grounded wires 3 is only one desired electrical discharge of the ionizer. The joint edge-groove type is meant to avoid any other undesired electrical discharge or current leakage, by lengthening any possible path for such phenomena. It is not possible to evolve an internal electrical discharge along a path 9*b* starting from the high voltage needle 6, along the external surface of the insulation of high voltage cable 4, between the contact surfaces of the insulating modules 1, following the joint surface between the edge 1*a*, and the groove 1*b*, ending at the metallic shape 2, because this path is very long. A current leakage between the high voltage needles 6, and grounded wires 3, due to a dirty top surface of the insulating module 1, should also follow a path 9*a*: starting from high voltage needle 6, along the dirty top surface of the insulating module 1, between the joint surfaces of the edge 1*a*, and of the groove 1*b*, ending to the grounded wire 3. The whole path becomes so long, that the current leakage can not develop itself.

FIG. 3 is a forward moved and lifted, sectional perspective view through a module of a shockless ionizer. The view is cut by the vertical plane of symmetry. A shockless ionizer consists of a row of such modules arranged on the metallic shape 2. The shockless ionizer has the same external appearance as the hot ionizer, the difference being inside construction. The high voltage needles 6 are capacitively coupled to the high voltage cable 4, supplied by a high voltage AC power supply, placed apart. The high voltage needles 6 are connected to a conductive, semicircular electrode 7, which represents one plate of the capacitor. The insulation of the high voltage cable 4 constitutes the dielectric of this capacitor. The other plate is the inner conductor 5 of the high voltage cable 4. The value of this capacitor (few pF.) depends on the area of the semicircular electrode 7, and on the thickness and the dielectric constant of the insulation of high voltage cable 4. Due to this capacitive coupling the corona current is limited to several microamperes per high voltage needle 6, even in the case that the needle is directly connected to the ground. A person who touches a high voltage needle 6, will not have a pain or electrical shock. Before the modules are arranged on the metallic shape, each module is prepared as follows. The high voltage needle 6 is introduced through an orifice drilled in the bottom of the insulating module 1, and jabbed into the semicircular electrode 7, and insulating module 1. Then, the said orifice is filled up with an insulating compound 8, in order to avoid any electrical discharge through it.

The process of neutralization, and the lengthened paths 9*a*, 9*b*, which avoid undesired electrical discharges, are similar to the process which takes place at the hot ionizer.

Figure 4:
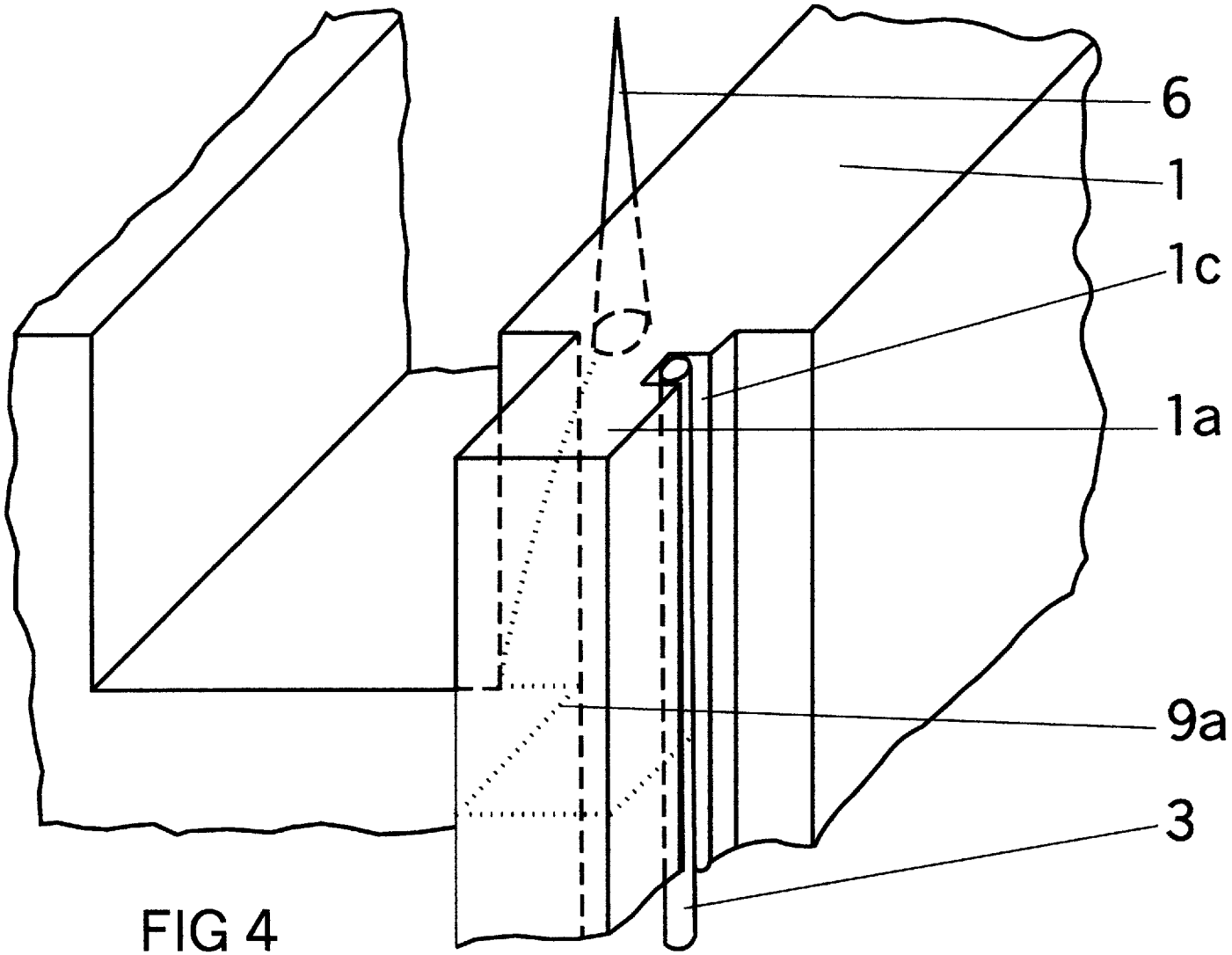
FIG. 4 is an enlarged perspective view of the top corner of the insulating module (FIG. 1)

FIG. 4 is an enlarged perspective view of the top corner of the insulating module 1 (FIG.1). It has been drawn for a better appearance of the special slits ic, where grounded wires 3 are fastened, and of the lengthened path 9*a*.

It will thus be seen that the devices set forth above, and those made apparent from the foregoing description, are effectively attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended all the generic and the specific features of the invention herein described, and all statements of the scope of the invention which, as a matter of language, might be said to fall therebetween.

What I claim as my invention is:

1. An ionizer for neutralization of static electricity built up on materials with high resistivity, when such materials are processed, comprising:

a row of insulating modules, arranged on a metallic shape connected to the ground, a thin grounded wire, which makes contact to said metallic shape, is fastened in a special slit in each joint of said insulating modules, on the side faced toward coming charged material, a high voltage cable, energized from a high voltage power supply, is inserted in the inner part of said insulating modules, symmetrical relative to lateral sides, a high voltage needle, jabbed into each said insulating module, is coupled to said high voltage cable, said grounded wires are symmetrically placed between said high voltage needles, and a distance exists between a high voltage needles row and a grounded wires row, a corona electrical discharge occurs between said high voltage needles row, and said grounded wires row, generating positive and negative ions, the coming charged material gets neutralized by small electrical discharges to the peaks of said grounded wires and/or by attracting ions of opposite polarity.

2. The ionizer of claim 1 wherein, each said high voltage needle makes contact to the internal conductor of said high voltage cable.

3. The ionizer of claim 1 wherein, each said high voltage needle is capacitively coupled to the said high voltage cable.

4. The ionizer of claim 1 wherein, in order to avoid undesirable electrical discharges, each said insulating module is shaped with an edge at one end, and a groove at other end, the track and profile of said edge and said groove are in the shape of U, and fit each other when said edge of one said insulating module is plugged into said groove of next said insulating module, this way, possible discharge paths starting from said high voltage needle, along the external surface of the insulation of said high voltage cable, following the joint surface between said edge and said groove, ending at said metallic shape, or starting from said high voltage needle, along the dirty top surface of said insulating module, between the joint surface of said edge and said groove, ending to said grounded wire, has been lengthened, and are no more possible to develop.

5. The ionizer of claim 1 wherein, said special slits are cut on both external sides of said edge of each said insulating module, in order to facilitate the fastening of said grounded wires on the right side or on the left side of said insulating modules.

* * * * *